US010155151B2

(12) United States Patent
Bealke

(10) Patent No.: US 10,155,151 B2
(45) Date of Patent: Dec. 18, 2018

(54) ENTERTAINMENT AND GAMING SYSTEMS AND METHODS

(71) Applicant: Robert Bealke, Brooklyn Park, MN (US)

(72) Inventor: Robert Bealke, Brooklyn Park, MN (US)

( * ) Notice: Subject to any disclaimer, the term of this patent is extended or adjusted under 35 U.S.C. 154(b) by 0 days.

(21) Appl. No.: 15/600,345

(22) Filed: May 19, 2017

(65) Prior Publication Data

US 2018/0333636 A1 Nov. 22, 2018

(51) Int. Cl.

| | |
|---|---|
| ***A63F 9/24*** | (2006.01) |
| ***A63F 13/00*** | (2014.01) |
| ***G06F 17/00*** | (2006.01) |
| ***G06F 19/00*** | (2018.01) |
| ***A63F 3/00*** | (2006.01) |
| ***A63F 3/06*** | (2006.01) |

(52) U.S. Cl.

CPC ..... *A63F 3/00119* (2013.01); *A63F 3/062* (2013.01); *A63F 3/0645* (2013.01); *A63F 9/24* (2013.01); *A63F 2003/00126* (2013.01); *A63F 2009/247* (2013.01); *A63F 2009/2457* (2013.01)

(58) Field of Classification Search

CPC .... A63F 3/00119; A63F 3/062; A63F 3/0645; A63F 9/24

See application file for complete search history.

(56) References Cited

U.S. PATENT DOCUMENTS 6,234,896 B1 * 5/2001 Walker ..... G07F 17/32 463/16

9,396,195 B1 * 7/2016 Beguelin ..... G06F 17/30053

* cited by examiner

*Primary Examiner* — Kevin Y Kim

(57) ABSTRACT

The disclosure includes a method of preparing and playing a video playlist for a game. The method can include determining an approximate number of players and selecting a prearranged video playlist comprising a plurality of videos. The number of videos contained within the prearranged video playlist can be based upon the approximate number of players. The method can also include playing, via a mixer and a display screen, a first video from the predetermined video playlist. Some methods can also include queuing, via the mixer, a second video from the predetermined video playlist.

20 Claims, 12 Drawing Sheets

ENTERTAINMENT AND GAMING SYSTEMS AND METHODS

BACKGROUND

Field

Various embodiments disclosed herein relate to entertainment. Certain embodiments relate to games played in a bar or restaurant.

Description of Related Art

Many bars and restaurants offer promotions and entertainment to attract customers to their establishments to increase sales. Specifically, many of these establishments provide games, such as trivia or bingo. Unfortunately, many of these games have become so commonplace and ordinary that they do not distinguish one establishment from another and therefore fail to attract customers. Additionally, many of these games require so much concentration from players that they then fail in their objective of trying to increase sales because customers are so riveted in the game that they don't purchase additional food and drinks. Thus, there is a need for entertainment and gaming systems and methods to attract customers and increase sales of bars and restaurants.

SUMMARY

This disclosure includes methods of preparing and playing a music video playlist for a game. Methods can comprise determining an approximate number of players and selecting, via a computing device, a prearranged music video playlist comprising a plurality of music videos. A number of music videos contained within the prearranged music video playlist can be based upon the approximate number of players. Methods can also include playing, via a mixer and a display screen, a first music video from the predetermined music video playlist and queuing, via the mixer, a second music video from the predetermined music video playlist.

In some embodiments, the method includes queuing, via the mixer, the first music video from the predetermined music video playlist. Additionally, methods can include determining a demographic of the players. In some embodiments, a genre of music videos contained within the prearranged music video playlist is based upon the demographic of the players.

Methods may also include queuing, via the mixer, a first plurality of music videos from the predetermined music video playlist. As well, some methods may include playing, via the mixer and the display screen, the first plurality of music videos from the predetermined music video playlist. Additionally, methods may include continuing queuing and playing, via the mixer and the display screen, the first plurality of music videos from the predetermined music video playlist until a first player wins the game. Methods can also include awarding the first player a first prize in response to the first player winning the game. In some embodiments, the prearranged music video playlist ensures that the first player will win the game within a first predetermined amount of time.

Some methods may include queuing, via the mixer, a second plurality of music videos from the predetermined music video playlist and playing, via the mixer and the display screen, the second plurality of music videos from the predetermined music video playlist. Methods may also include continuing queuing and playing, via the mixer and the display screen, the second plurality of music videos from the predetermined music video playlist until a second player wins the game. Additionally, methods may include awarding the second player a second prize in response to the second player winning the game.

Methods can even include queuing, via the mixer, a third plurality of music videos from the predetermined music video playlist and playing, via the mixer and the display screen, the third plurality of music videos from the predetermined music video playlist. Some methods may include continuing queuing and playing, via the mixer and the display screen, the third plurality of music videos from the predetermined music video playlist until a third player wins the game. Accordingly, methods can include awarding the third player a third prize in response to the third player winning the game.

In some embodiments, the prearranged music video playlist ensures that the second player will win the game within a second predetermined amount of time and that the third player will win the game within a third predetermined amount of time.

Even still, in some embodiments, the plurality of music videos comprises a plurality of songs performed by a plurality of musicians. In some embodiments, each musician among the plurality of musicians has only one song among the plurality of songs.

Methods may even include distributing at least one playing card to each of the players. In some embodiments, the at least one playing card comprises a plurality of squares. A majority of the squares can comprise bibliographic information comprising at least one of a musician name and a song title.

In some embodiments, the plurality of squares is arranged in a rectangular pattern. In some embodiments, the plurality of squares comprises 25 squares.

Even still, in some embodiments, when the first player wins the game the first player has matched at least four music videos with at least four squares on a playing card. In some embodiments, the at least four squares comprise bibliographic information related to the at least four music videos. As well, in some embodiments, the at least four squares are arranged in a predetermined pattern.

The embodiments described above include many optional features and aspects. Features and aspects of the embodiments can be combined.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments.

DETAILED DESCRIPTION

Figure 1:
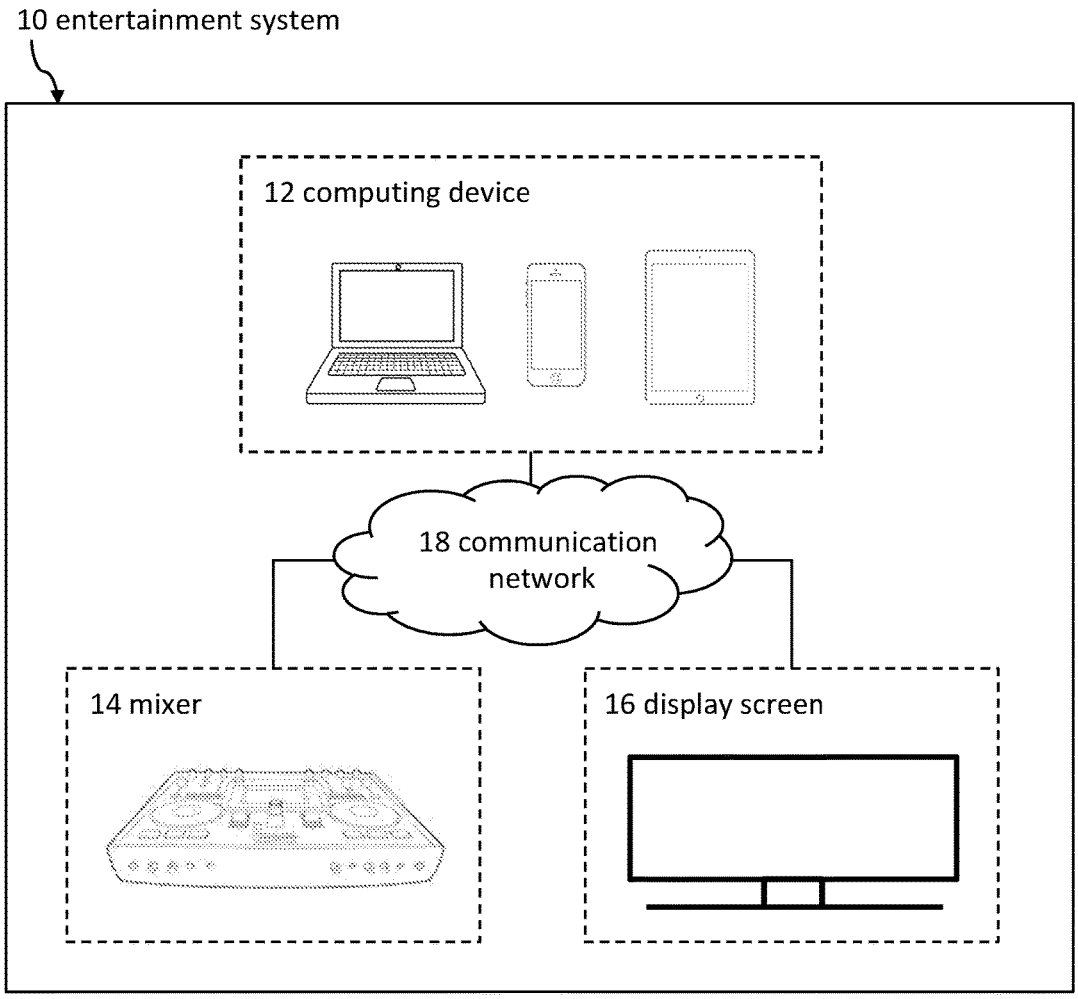
FIG. 1 illustrates an entertainment system, according to some embodiments.

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

LIST OF REFERENCE NUMERALS

10—Entertainment system
12—Computing device (e.g. laptop, smart phone, and/or tablet device)
14—Mixer (e.g. audio and/or video mixer)
16—Display screen (e.g. television)
18—Communication network
20—Prearranged music video playlist
22—Plurality of music videos
24—Plurality of songs
26—Playing card
28—Squares
40—First winning configuration
42—Second winning configuration
44—Third winning configuration
46—Fourth winning configuration
48—Fifth winning configuration
50—Sixth winning configuration Introduction This disclosure includes entertainment and gaming systems and methods that can help businesses, such as bars and restaurants, attract more customers and increase sales. The systems and methods disclosed herein can take elements from common games, such as trivia and bingo, and combine them with other entertainment medium, such as songs and music videos, and transform them into novel entertainment and gaming systems and methods. The resulting systems and methods may not only help bars and restaurants achieve their business objectives, but also provide customers an intriguing and social way of being entertained while patronizing said businesses.

Specifically, the entertainment and gaming systems and methods disclosed herein can be referred to as Vingo®. Similar to the traditional game of bingo, Vingo® is a game of chance in which a game participant, or player, listens to a song and/or watches a music video and then tries to identify the name of the musician or song title with musicians names and/or song titles pre-printed in different arrangements on a playing card, such as a 5×5 card. The songs and/or music videos are selected and played at random by a game host, such as a disc jockey. When a player identifies four or five musician's name and/or song titles on their playing card in a winning arrangement, they can call out "Vingo!" to alert all participants of their winning card, which prompts the game host to examine the playing card for verification of the win. Players can compete against one another to be the first to have a winning arrangement for the prize or jackpot. In some embodiments, after one winner is declared, the game is complete and a new round of play can begin. However, in some embodiments, the game is not complete until two or more winners are declared, whereby a new round of play can begin.

Entertainment and Gaming Systems

As shown in FIG. 1, the entertainment and gaming systems and methods can be implemented via entertainment system 10. The system 10 can include a computing device 12 communicatively coupled to a mixer 14 and a display screen 16, via a communication network 18. The computing device 12 can include any device, such as a laptop computer, desktop computer, smart phone, tablet device, and the like. Additionally, the mixer 14 can include an audio and/or video mixer, and the like. The display screen 16 can include a television, computer monitor, and any type screen that displays moving and/or still images. Moreover, the communication network 18 can comprise any type of wired or wireless network, such as radio, Wi-Fi (e.g., wireless local area network), cellular, Internet, Bluetooth, telecommunication, Ethernet, and the like.

Figure 2:
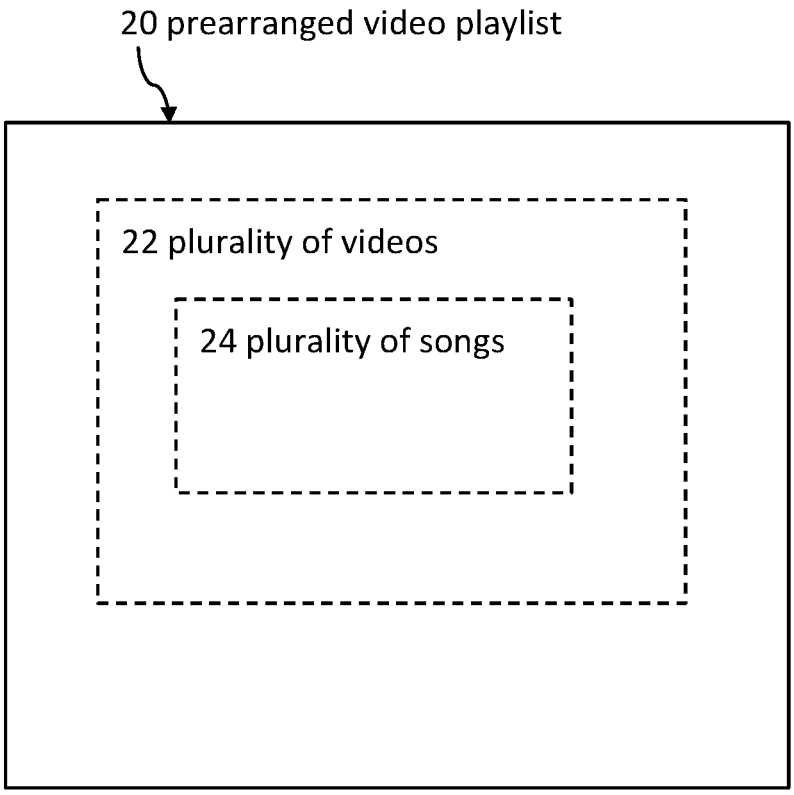
FIG. 2 illustrates a prearranged music video playlist, according to some embodiments.

With reference to FIG. 2, the system 10 can also include a prearranged music video playlist 20, which can include a plurality of music videos 22. The plurality of music videos 22 can include a plurality of songs 24 performed by a plurality of musicians. In some embodiments, each musician among the plurality of musicians has only one song among the plurality of songs. The prearranged music video playlist 20 can be stored via the computing device 12, while the plurality of music videos 22 and the plurality of songs 24 can be selected and queued via the computing device 12 and the mixer 14 by a game host. Furthermore, the plurality of videos 22 and plurality of songs 24 can be played via the display screen 16 for the players to see and hear.

Figure 3:
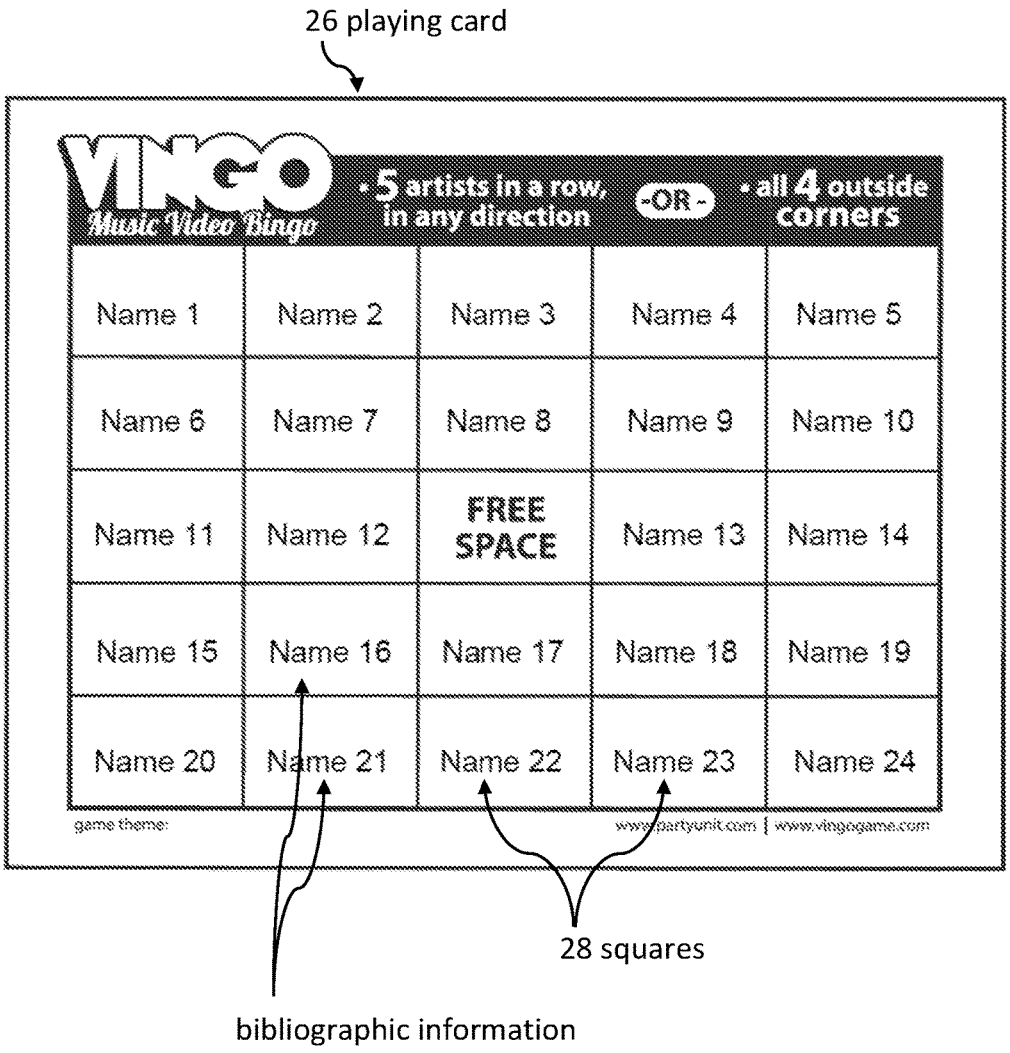
FIG. 3 illustrates a playing card, according to some embodiments.

As illustrated in FIG. 3, the system 10 can also include a playing card 26. The playing card 26 can include a plurality of squares 28. In some embodiments, a majority of the squares 28 comprises bibliographic information (e.g. Name 1, Name 2, etc.) including information such as a musician name and/or a song title. In some embodiments, the plurality of squares includes 25-squares, whereby 24 of the 25-squares includes bibliographic information, with the $25^{th}$ square being a "free space" that is complimentary to the player. In some embodiments, the plurality of squares can be arranged in a pattern, such as a rectangular pattern.

Figure 4:
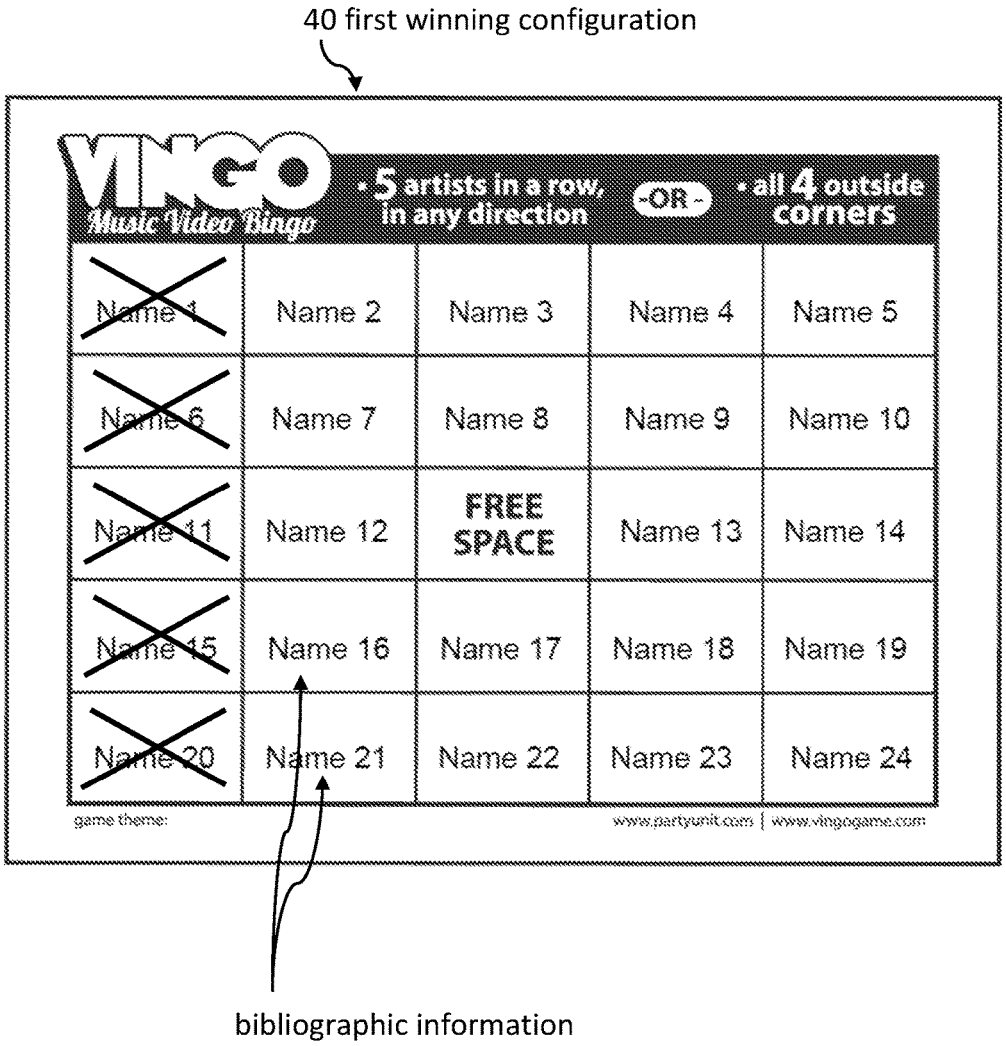
FIGS. 4-9 illustrate different winning configurations of playing cards, according to some embodiments.
Figure 5:
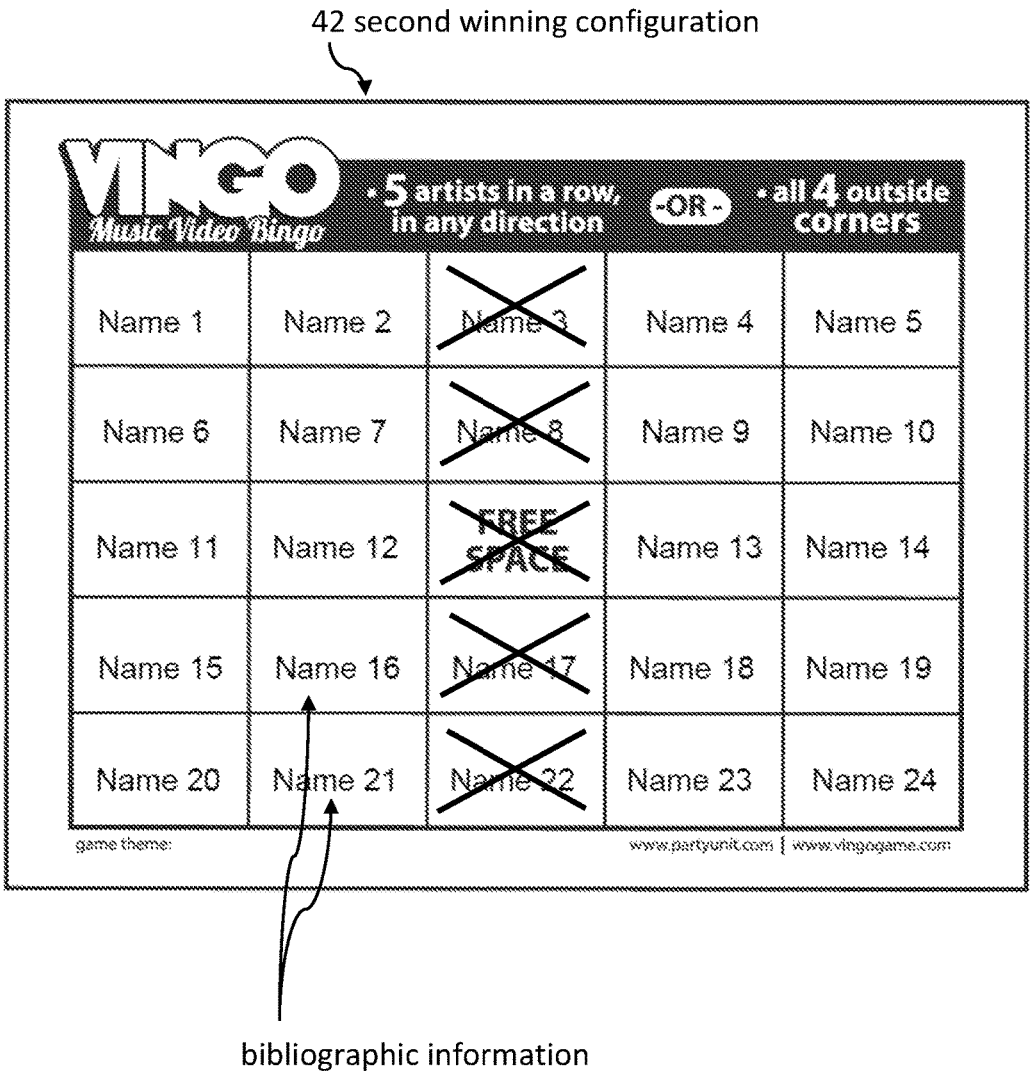

Now with collective reference to FIGS. 4-9, because the game disclosed herein is modeled after bingo, the game can be won in a number of configurations similar to traditional bingo. As shown in FIG. 4, a first winning configuration 40 is defined by any five consecutive tiles being "checked off" in any of the vertical columns, such as the one shown in FIG. 4. As shown in FIG. 5, the second winning configuration 42 is defined by five tiles being "checked off" in the middle vertical column. FIG. 5 can be distinguished from FIG. 4 because the "Free Space" is a complimentary space awarded to every player. In this regard, the player only needs to "check off" the four remaining tiles in the middle column.

Figure 6:
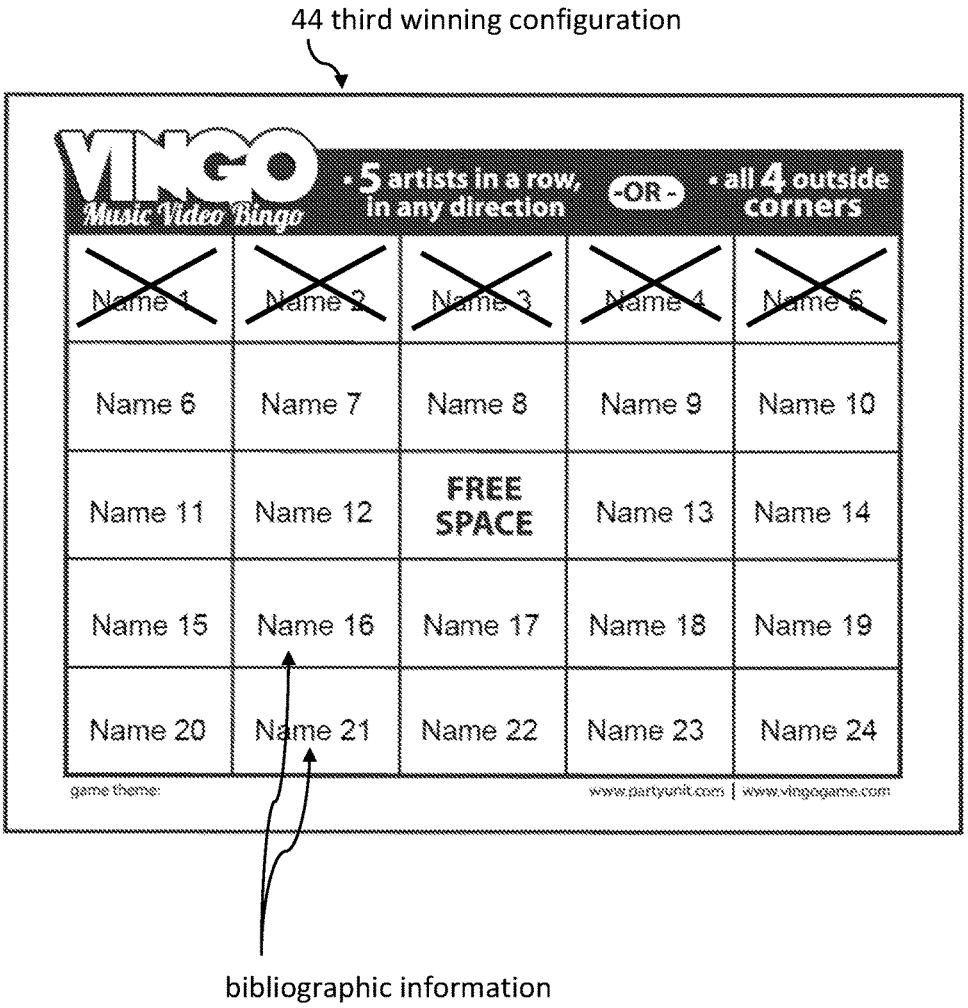
Figure 7:
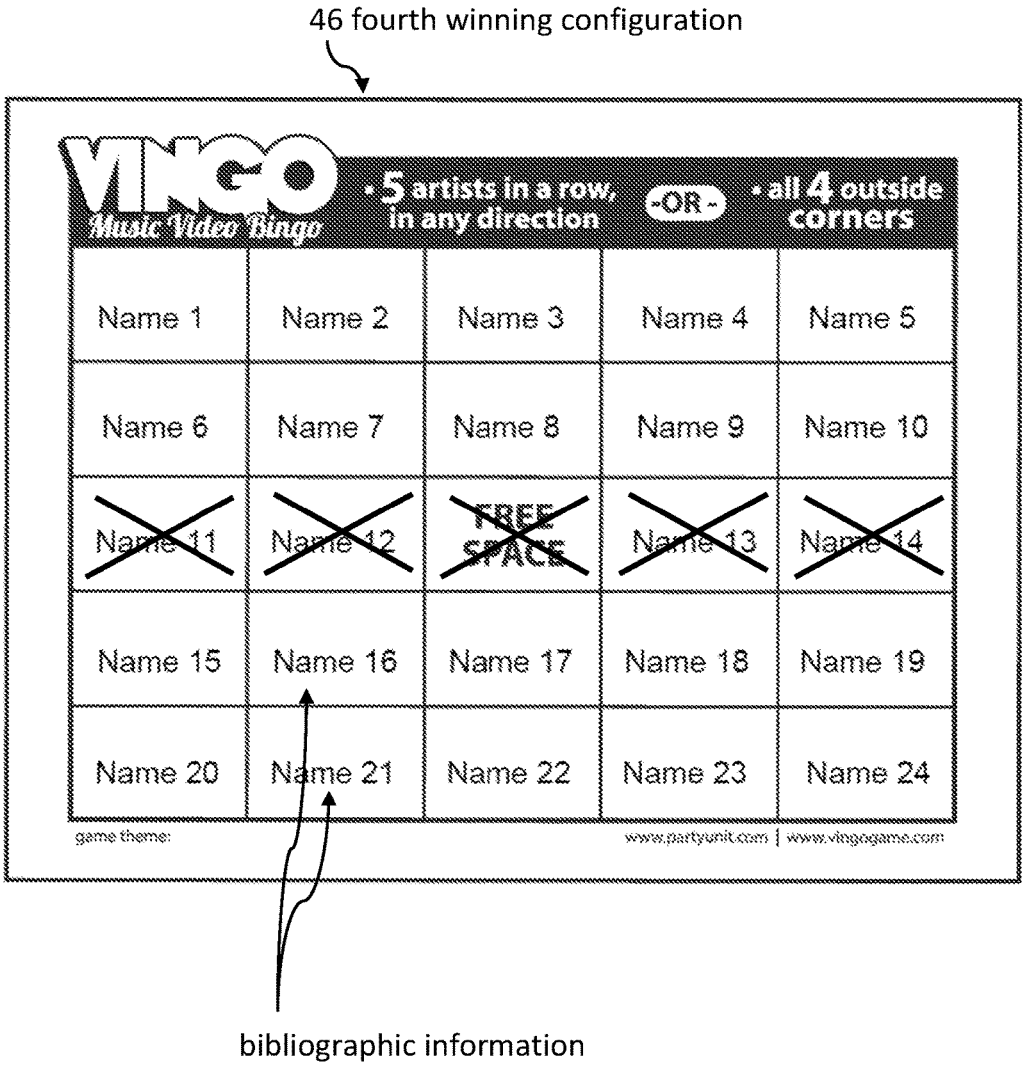

As illustrated in FIG. 6, a third winning configuration 44 is defined by any five consecutive tiles being "checked off" in any of the horizontal rows, such as the one shown in FIG. 6. As shown in FIG. 7, the fourth winning configuration 46 is defined by five tiles being "checked off" in the middle horizontal row. Similar to above, FIG. 7 can be distinguished from FIG. 6 because the "Free Space" is a complimentary space, and the player only needs to "check off" the four remaining tiles in the middle row.

Figure 8:
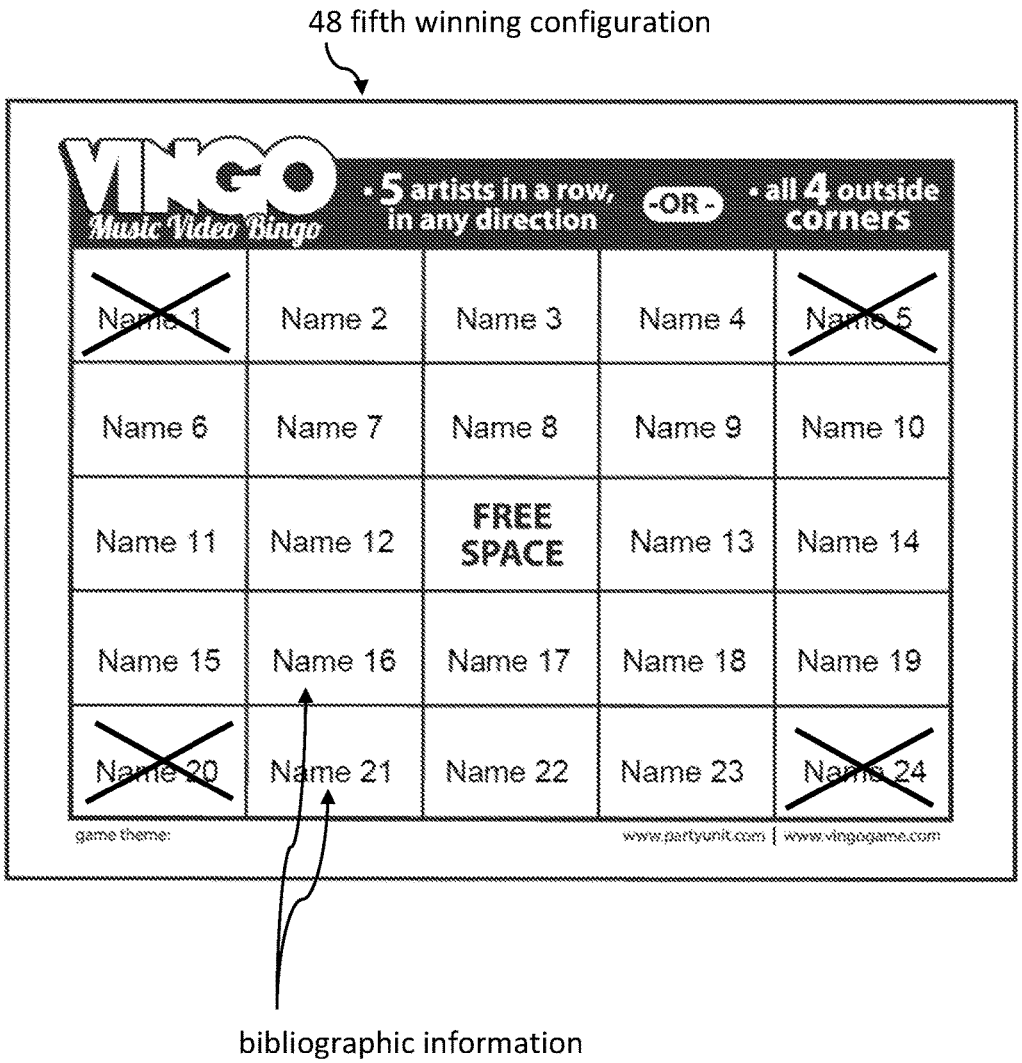
Figure 9:
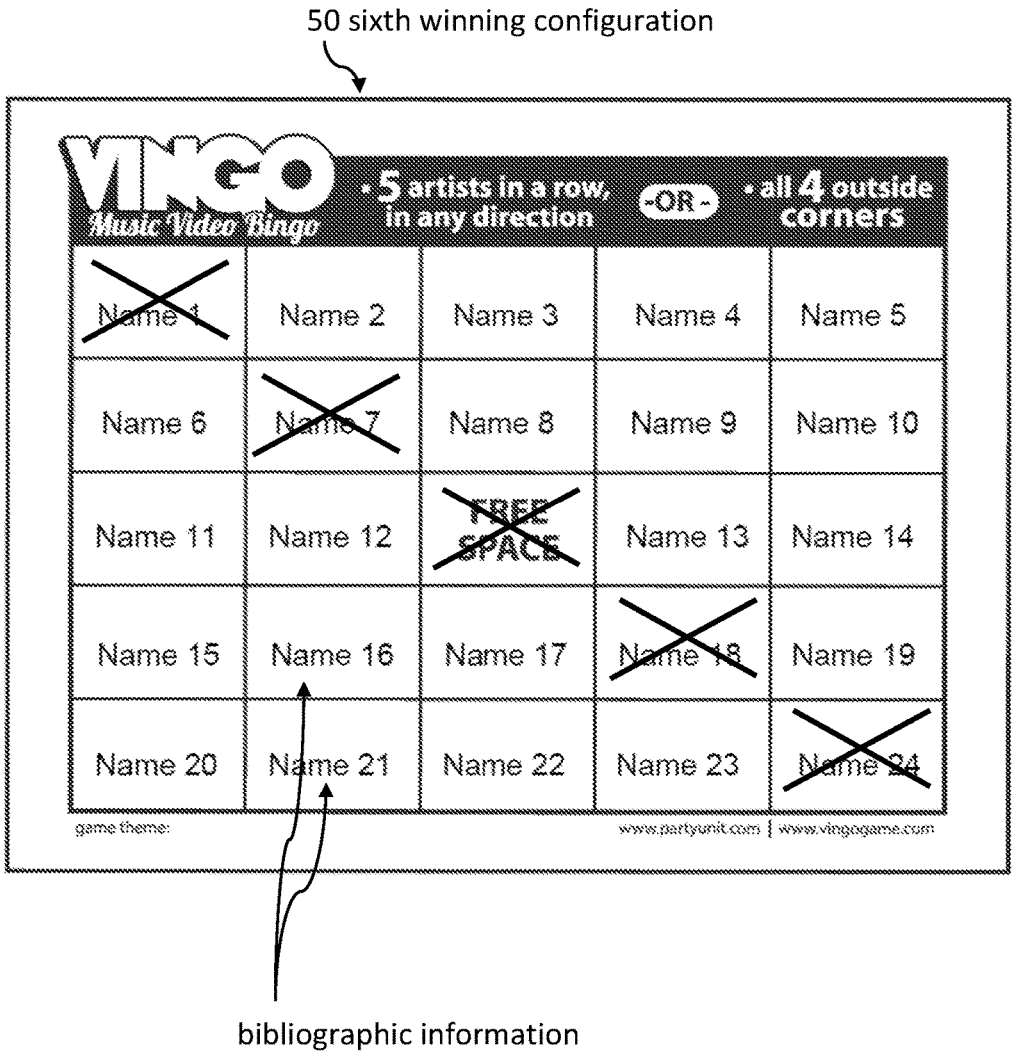

Furthermore, FIG. 8 illustrates a fifth winning configuration 48 that is defined by the four corner tiles being "checked off". Lastly, as shown in FIG. 9, a sixth winning configuration is defined by five consecutive tiles being "checked off" in a diagonal pattern from bottom left to top right or top left to bottom right, as shown in FIG. 9.

Entertainment and Gaming Methods

Figure 10:
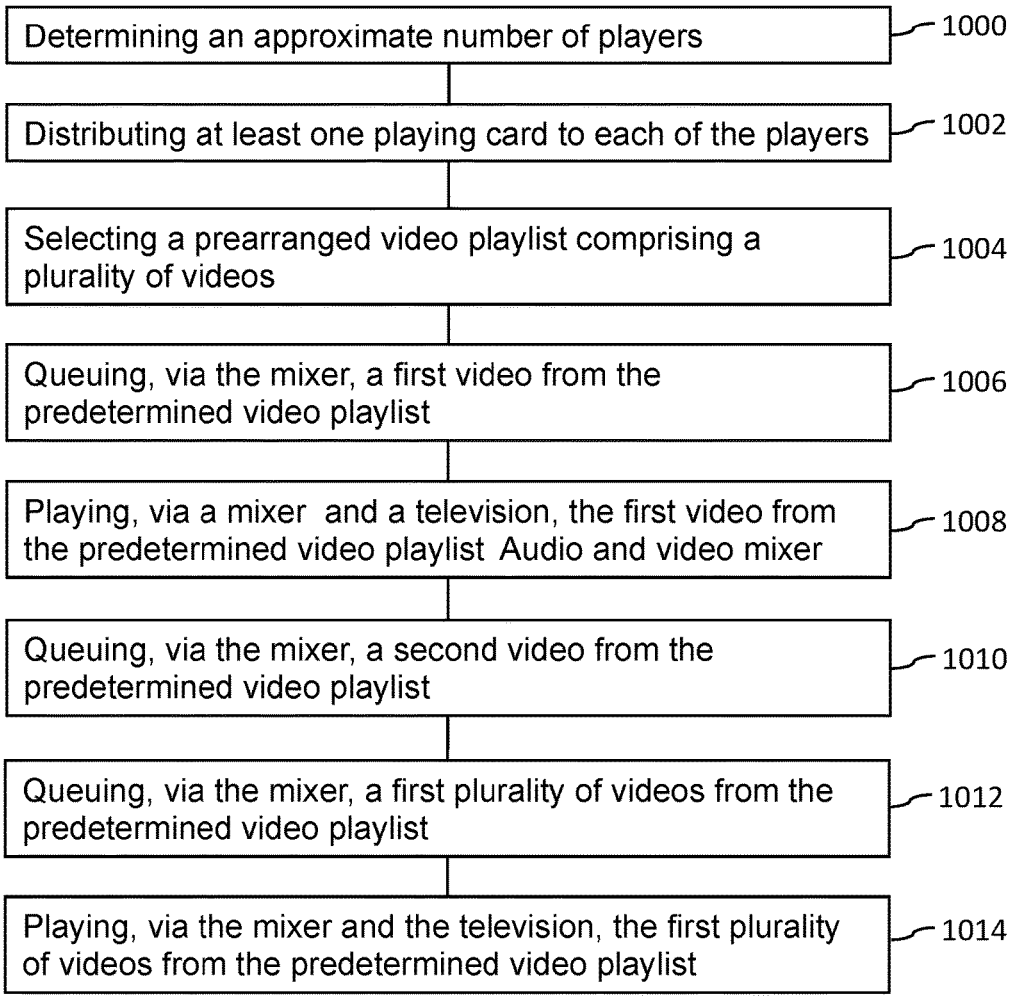
FIGS. 10-12 illustrate flow charts for preparing and playing a music video playlist for a game, according to some embodiments.
Figure 11:
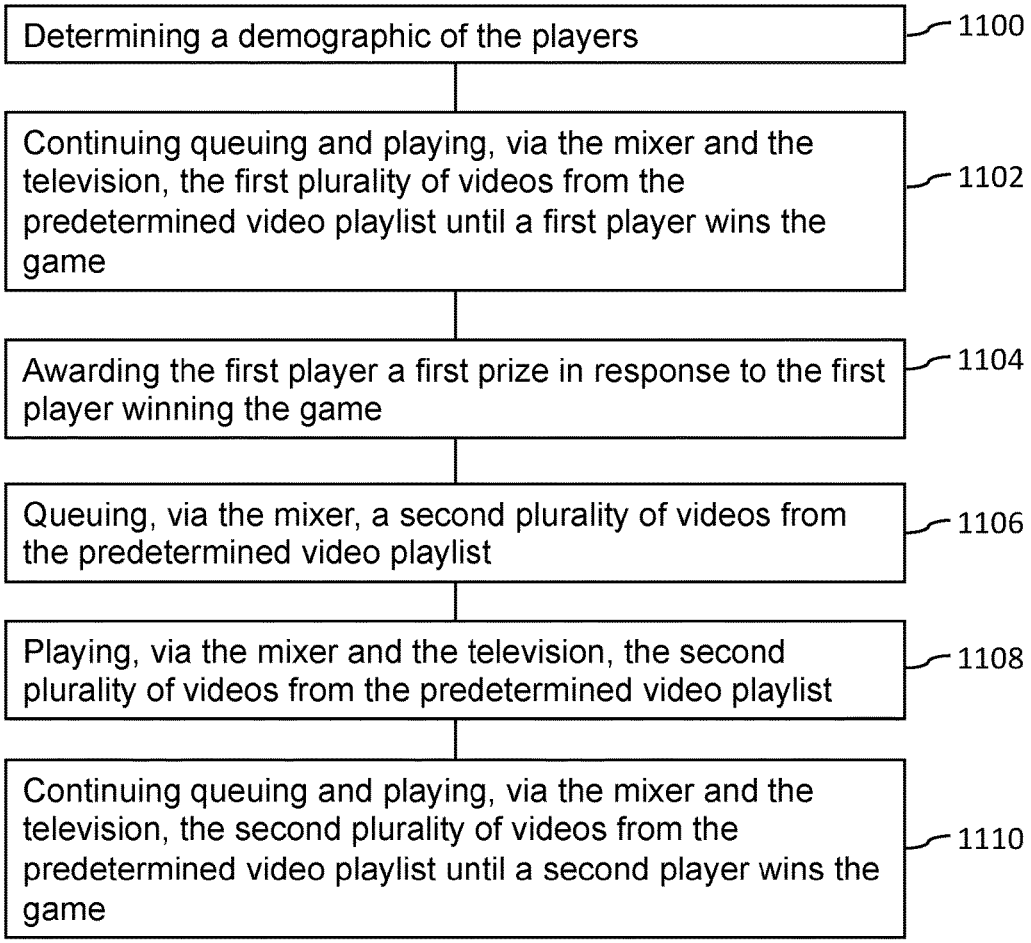
Figure 12:
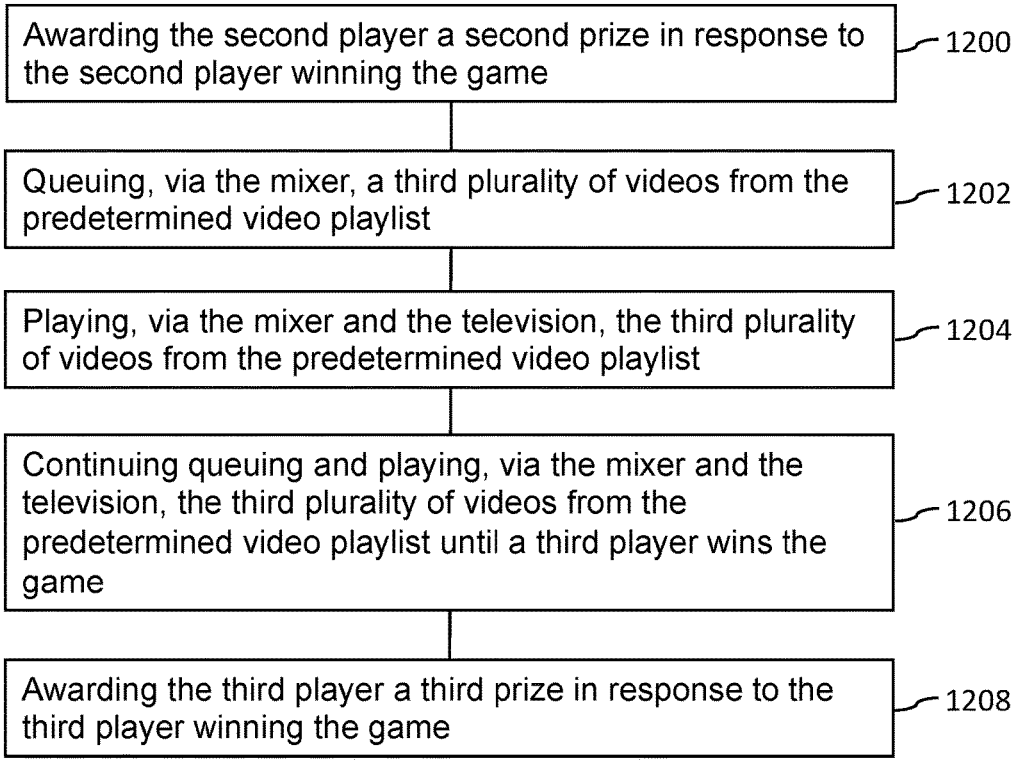

With reference to FIGS. 10-12, the entertainment and gaming systems described above can be implemented via a number of different method steps that will now be discussed. As shown in FIG. 10, the systems can be implemented via a method of preparing and playing a music video playlist that includes the steps of determining an approximate number of players (at step 1000). It should be appreciated that determining the approximate number of players can be performed by simply estimating the number of people in the crowd, or more exact methods, such as by distributing at least one playing card 26 to each of the players (at step 1002). Methods can also include selecting, via a computing device 12, a prearranged video playlist 20 comprising a plurality of music videos 22 (at step 1004).

In some embodiments, the number of music videos contained within the prearranged music video playlist 22 depends upon the approximate number of players. In this regard, the number of videos on the video playlist 20 and the selection of the playlist 20 can play a vital role to ensure that the game ends within an appropriate or predetermined amount of time. For example, if the game includes only 5-players, then the number of musician's names and/or song titles on the playing cards 26 distributed to the players is much smaller then if there were 50-players. In this regard, if the game includes only 5-players, then the selected video playlist 20 should include a smaller number of videos to be played during the game. If the selected video playlist 20 includes too many videos, then the game could take too long before a winner is revealed. This can be important because bars and restaurants schedule events to begin and end at predetermined times and they cannot have games, such as Vingo®, taking too long. In this manner, the game host can have many prearranged video playlists 20 stored on the computing device 12 to match any number of players participating in the game. For example, the host could be as precise as to 1,000 or more prearranged video playlists 20 stored on the remote computing device. This could allow the host to count and select the prearranged video playlist 20 down to the exact number of players participating. For example, if the host determines that there are 37-players then the host may select a different playlist 20 then if there were 36 or even 38-players. However, in many embodiments, the host will likely have fewer than 1,000 prearranged video playlists 20 and the host will estimate the number of players (e.g. less than 75-players, between 75 and 100-players, more than 100-players, etc.) and then select a video playlist 20 accordingly.

In addition to controlling the duration of the game by selecting prearranged music video playlists 20 that are directly related to the number of players, the host may also control the duration by distributing more or less playing cards 26 to the players. For example, if only 25-players are participating and the host wants the game to last as long as a 75-player game, the host would thereby distribute three times as many cards to each of the 25-players. Even still, if 500-players are participating, and the 500-players want to use two playing cards 26, the host may need to select a playlist for a number of players greater than 500-players, such as 1,000-players. This can thereby ensure that the game will last for a predetermined or desired duration. Generally, the host may control the game by manipulating the two factors, video playlist size and number of playing cards 26 distributed, to ensure that the game ends when the host wants the game to end. For example, the host can distribute more or less playing cards 26 to players, while using a video playlist 20 having more or less videos. The host should be aware that an increase or decrease in one of the factors will likely require an increase or decrease in the other factor to ensure that the game still ends within the predetermined amount of time.

Once the appropriate music video playlist 20 has been selected, methods can include queuing, via the mixer 14, a music first video from the predetermined video playlist 22 (at step 1006) and playing, via the mixer 14 and a display screen 16, the first video from the predetermined video playlist 20 (at step 1008). The players can thereby watch and listen to the display screen 16 to determine if the video being played is performed by a musician whose name is listed on their playing card 26 or if the video is a song title also listed on their playing card 26. If it is, then the player can "check off" the appropriate square containing the name of the musician and/or song title.

To move the game along, the game host can proceed queuing, via the mixer 14, a second music video from the predetermined music video playlist 20 to be played after the first video (at step 1010). The host may even opt to queue more than one video at once, which may include queuing, via the mixer 14, a first plurality of videos from the predetermined video playlist 20 (at step 1012). Accordingly, methods may thereby include playing, via the mixer 14 and the display screen 16, the second video and/or the first plurality of videos from the predetermined video playlist 20 (at step 1014).

In several embodiments, the game host selects the music video playlist 20 based upon the number of players in the game. Although, there are other factors that may determine which video playlist 20 the host selects. For example, methods may include determining a demographic of the players (e.g. age, sex, and the like). Based upon the demographic of the players, the host may then select a prearranged video playlist 20 having a genre of music videos commonly liked and listened to by that demographic of players (at step 1100). For example, the host may determine that the players are 21 to 25 years of age and the host thereby selects pop music or another musical genre that is more suited to the age of the players. Alternatively, the host may determine that the players are 50 to 60 years of age. In this regard, the host may select music from another genre of music, such as a specific decade (e.g. 1970s music).

Additionally, the game host will likely want the game to proceed continuously and seamlessly, in this regard, the host may perform steps, such as queuing, via the mixer 14, a first plurality of music videos from the predetermined music video playlist 20 (at step 1102). In this regard, the host can preselect and queue the first plurality of videos from the predetermined video playlist 20 and then automatically queue the first plurality of videos to continue playing, via the mixer 14 and the display screen 16, without the host's attention. The host can continue queuing music until a variety of events occur, such as a player winning the game, a predetermined amount of time elapsing, and the like.

Moreover, the game host will likely want to incent people to participate and join the game. As such, many methods may include awarding the first player a first prize in response to the first player winning the game (at step 1104).

The game host may queue and play music according to a variety of different scenarios. For example, if the typical game lasts 55 to 65 minutes, the host may queue and play enough music (e.g. the first plurality of music videos) to last for the first 55 minutes. The host may thereby queue and play a second plurality of videos, which may fill a much smaller segment of time, such as 5 to 10 minutes. In this regard, methods may include queuing, via the mixer 14, a second plurality of videos from the predetermined music video playlist 20 (at step 1106) and playing, via the mixer 14 and the display screen 16, the second plurality of videos from the predetermined video playlist 20 (at step 1108). Alternatively, the host may queue and play the music until a second winner wins the game. In this regard, the method may include continuing queuing and playing, via the mixer 14 and the display screen 12, the second plurality of videos from the predetermined video playlist 20 until a second player wins the game (at step 1110). Additionally, many methods may likely include awarding the second player a second prize in response to the second player winning the game (at step 1200).

As the game progresses closer to completion, the game host may have to be more engaged and attuned to the number of songs being played towards the end. If the game is awarding prizes to multiple winners, such as three or more winners, it is likely that the second and third winners will likely come in close sequence. In this regard, the host may queue a smaller number of songs for a third plurality of music videos. As such, methods may include queuing, via the mixer 14, a third plurality of videos from the predetermined music video playlist 20 (at step 1202) and playing, via the mixer 14 and the display screen 16, the third plurality of videos from the predetermined video playlist 20 (at step 1204). Additionally, the method may include continuing queuing and playing, via the mixer 14 and the display screen 16, the third plurality of videos from the predetermined video playlist 20 until a third player wins the game (at step 1206). Again, similar to above, many methods may include awarding the third player a third prize in response to the third player winning the game (at step 1208).

Interpretation

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

Some of the devices, systems, embodiments, and processes use computers. Each of the routines, processes, methods, and algorithms described in the preceding sections may be embodied in, and fully or partially automated by, code modules executed by one or more computers, computer processors, or machines configured to execute computer instructions. The code modules may be stored on any type of non-transitory computer-readable storage medium or tangible computer storage device, such as hard drives, solid state memory, flash memory, optical disc, and/or the like. The processes and algorithms may be implemented partially or wholly in application-specific circuitry. The results of the disclosed processes and process steps may be stored, persistently or otherwise, in any type of non-transitory computer storage such as, e.g., volatile or non-volatile storage.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments include A, B, and C. The term "and/or" is used to avoid unnecessary redundancy.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

The following is claimed:

1. A method of selecting and playing a video playlist for a bingo-like game, comprising:

determining a number of game players;

distributing at least one playing card to each game player;

selecting, via a computing device, a prearranged video playlist comprising a plurality of videos, wherein a number of videos contained within the prearranged video playlist is based upon the number of game players;

playing, via a mixer and a display screen, at least one video from the predetermined video playlist, wherein the at least one video represents bibliographic data comprising at least one of a musician name and a song title, wherein the prearranged video playlist ensures that the bingo-like game will end within a predetermined amount of time, and wherein the bingo-like game ends when at least one game player has identified at least one bibliographic data with a corresponding bibliographic data located on a playing card of the at least one playing card.

2. The method of claim 1, further comprising determining a demographic of the players, wherein a genre of videos contained within the prearranged video playlist is based upon the demographic of the players.

3. The method of claim 1, further comprising continuing playing, via the mixer and the display screen, the at least one video until a first game player has identified at least one bibliographic data from the at least one video with a corresponding bibliographic data located on a first playing card.

4. The method of claim 3, further comprising awarding the first game player a first prize.

5. The method of claim 4, further comprising continuing playing, via the mixer and the display screen, the at least one video until a second game player has identified at least one bibliographic data from the at least one video with a corresponding bibliographic data located on a second playing card.

6. The method of claim 5, further comprising awarding the second player a second prize.

7. The method of claim 6, further comprising continuing playing, via the mixer and the display screen, the at least one video until a third game player has identified at least one bibliographic data from the at least one video with a corresponding bibliographic data located on a third playing card.

8. The method of claim 7, further comprising awarding the third player a third prize.

9. The method of claim 7, wherein the prearranged video playlist ensures that the second game player will win the bingo-like game within a second predetermined amount of time and that the third game player will win the bingo-like game within a third predetermined amount of time.

10. The method of claim 1, wherein the at least one video comprises a plurality of songs performed by a plurality of musicians, and wherein each musician among the plurality of musicians has only one song among the plurality of songs.

11. The method of claim 1, wherein the at least one playing card comprises a plurality of squares, and wherein a majority of the squares comprises the bibliographic information comprising at least one of the musician name and the song title.

12. The method of claim 11, wherein the plurality of squares is arranged in a rectangular pattern.

13. The method of claim 12, wherein the plurality of squares comprises 25 squares.

14. The method of claim 3, further comprising continuing playing, via the mixer and the display screen, the at least one video until the first game player has identified at least four bibliographic data from the at least one video with the corresponding bibliographic data located on the first playing card.

15. The method of claim 14, wherein the at least four bibliographic data identified on the first playing card are arranged in a predetermined pattern.

16. The method of claim 15, wherein the predetermined pattern comprises at least one of four corner squares of the playing card, five consecutive squares in a column of the playing card, five consecutive squares in a row of the playing card, and five consecutive squares in a diagonal configuration of the playing card.

17. The method of claim 1, further comprising marking, by the at least one game player, a first square of the playing card to indicate that the playing card comprises bibliographic data of the at least one video.

18. The method of claim 17, further comprising marking, by the at least one game player, a second square of the playing card to indicate that the playing card comprises bibliographic data of the at least one video.

19. The method of claim 18, further comprising marking, by the at least one game player, a third square of the playing card to indicate that the playing card comprises bibliographic data of the at least one video.

20. The method of claim 19, further comprising marking, by the at least one game player, a fourth square of the playing card to indicate that the playing card comprises bibliographic data of the at least one video.

* * * * *